US005330850A

United States Patent [19]

Suzuki et al.

[11] Patent Number: 5,330,850

[45] Date of Patent: Jul. 19, 1994

[54] CORROSION-RESISTANT SURFACE-COATED STEEL SHEET

[75] Inventors: Nobukazu Suzuki, Ibaraki; Seiji Bando, Osaka; Satoshi Ikeda, Ibaraki; Tetsuaki Tsuda; Atsuhisa Yakawa, both of Nishinomiya; Yukihiro Yoshikawa, Osaka, all of Japan

[73] Assignee: Sumitomo Metal Industries, Ltd., Osaka, Japan

[21] Appl. No.: 997,666

[22] Filed: Dec. 28, 1992

Related U.S. Application Data

[63] Continuation of Ser. No. 687,675, Apr. 19, 1991, abandoned.

[30] Foreign Application Priority Data

| | | | |
|---|---|---|---|
| Apr. 20, 1990 | [JP] | Japan | 2-105049 |
| Jul. 16, 1990 | [JP] | Japan | 2-187515 |
| Jul. 21, 1990 | [JP] | Japan | 2-193465 |
| Aug. 11, 1990 | [JP] | Japan | 2-212101 |

[51] Int. Cl.[5] ..... B32B 15/08

[52] U.S. Cl. ..... 428/623; 428/626; 428/659

[58] Field of Search ..... 428/613, 622, 626, 658, 428/659, 427.1, 623

[56] References Cited

U.S. PATENT DOCUMENTS

| | | | |
|---|---|---|---|
| 4,548,868 | 10/1985 | Yonezawa et al. | 428/658 |
| 4,659,631 | 4/1987 | Kurimoto et al. | 428/659 |
| 4,940,639 | 7/1990 | Ohshima et al. | 428/659 |

FOREIGN PATENT DOCUMENTS

| | | |
|---|---|---|
| 2611267 | 9/1976 | Fed. Rep. of Germany . |
| 58-006995 | 1/1983 | Japan . |
| 59-162292 | 9/1984 | Japan . |
| 60-138093 | 7/1985 | Japan . |
| 60-215789 | 10/1985 | Japan . |
| 2178760A | 2/1987 | United Kingdom . |

*Primary Examiner*—Benjamin R. Fuller
*Assistant Examiner*—Valerie Ann Lund
*Attorney, Agent, or Firm*—Burns, Doane, Swecker & Mathis

[57] ABSTRACT

A surface-coated steel sheet having improved corrosion resistance and suitable for use as automobile inner and outer panels comprises a steel sheet having on at least one surface thereof a composite coating which comprises the following layers (a) to (d) from the bottom to the top of the coating:

(a) a first zinc alloy plating layer with a coating weight of 10–100 g/m$^2$ which contains at least one of Ni and Co in an amount satisfying the following inequality:

$$0.05 \leqq (5 \times Co) + Ni \leqq 10 \quad \text{(in weight percent)},$$

(b) a second zinc alloy plating layer with a coating weight of 0.05–10 g/m$^2$ which contains at least one of Ni and Co in an amount satisfying the following inequality:

$$10 < (5 \times Co) + Ni \leqq 40 \quad \text{(in weight percent)},$$

(c) a chromate film layer with a coating weight of 20–300 mg/m$^2$ as Cr, and (d) an organic coating layer with a thickness of 0.2–5 μm.

22 Claims, 2 Drawing Sheets

Fig. 1(a)
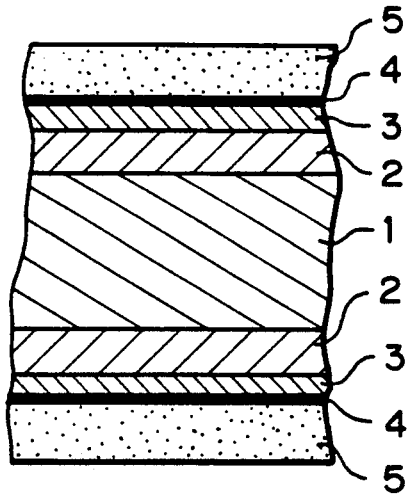
Fig. 1(b)
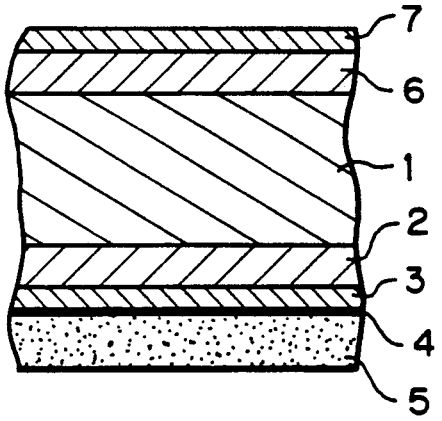
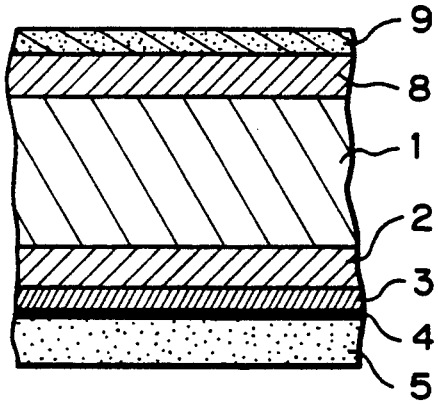
Fig. 1(c)
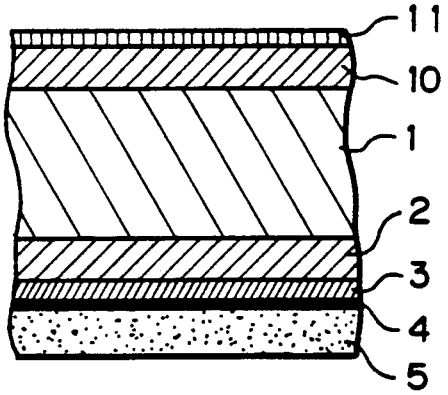
Fig. 1(d)

CORROSION-RESISTANT SURFACE-COATED STEEL SHEET

This application is a continuation of U.S. patent application Ser. No. 07/687,675, filed Apr. 19, 1991, now abandoned.

BACKGROUND OF THE INVENTION

The present invention relates to an improved corrosion-resistant, surface-coated steel sheet. More particularly, the invention relates to a corrosion-resistant steel sheet coated with a multilayer organic-inorganic composite coating which has good weldability and formability in addition to good corrosion-preventing properties even if a protecting paint coating is injured and which is especially suitable for use as automobile panels including outer panels.

In recent years, requirements for corrosion resistance of steel sheets for use as automobile panels have become increasingly strict. For example, such steel sheets are required to resist perforative corrosion for 10 years and surface rusting for 5 years in north America and Europe where severe corrosive conditions are created in winter since rock salt is generally spread on roads in order to prevent them from freezing.

Under these circumstances, surface-coated, weldable steel sheets have been substituted for conventional cold-rolled steel sheets to fabricate inner and outer panels of automobiles. For this purpose, steel sheets plated with zinc or a zinc alloy have been frequently used, but they do not have adequate corrosion resistance unless the zinc or zinc alloy plating has an extremely large thickness. However, such thick plating adversely affects the press-formability of the plated steel sheet and powdering and flaking of the plating tend to occur during press-forming of the sheet into the shape of an automobile panel.

Japanese Patent Application Kokai No. 58-6995(1983) describes a Zn-Ni alloy-plated steel sheet having on at least one surface thereof a first (lower) Zn-Ni alloy plating layer of a $(\eta+\gamma)$ dual phase containing 2–9 wt % of Ni and having a thickness of 0.05–2 μm and a second (upper) Zn-Ni alloy plating layer of a $\gamma$ single phase containing 10–20 wt % of Ni and having a thickness of 0.2–10 μm wherein the thickness ratio of the first layer to the second layer is from 1:5 to 1:100. The duplex Ni-Zn plating is effective to prevent cosmetic corrosion and surface rusting after paint coating.

The thickness of the upper plating layer which has a higher Ni content and which is more brittle than the lower plating layer is much greater than that of the lower plating. Therefore, in a low-temperature chipping test which simulates the situation that pebbles hit against a car body in winter, the plating will be peeled away or chipped off over a large area, leading to a decrease in ultimate corrosion resistance. Furthermore, the presence of the thick, high-Ni alloy upper layer which is relatively noble is considered to accelerate corrosion of the relatively thin, low-Ni alloy lower layer and also increases the costs of the plated steel sheet, since Ni is rather expensive.

Another type of corrosion resistant, surface-coated steel sheet which has been developed is based on a zinc or zinc-alloy plated steel sheet and has a chromate film and an organic coating thereon. Thus, this type of coated steel sheet has a multilayer inorganic-organic composite coating on at least one surface.

A typical example of such a surface-coated steel sheet is known as Zincrometal ®. It has an organic coating of a zinc-rich primer. However, it does not have sufficient corrosion resistance and tends to suffer from powdering of the coating during press-forming due to the presence of a large amount of Zn powder in the uppermost organic coating.

Surface-coated steel sheets having a chromate film and an organic composite silicate coating on a zinc or zinc alloy-plated steel sheet have been disclosed in Japanese Patent Application Kokai Nos. 57-108212(1982), 58-224174(1983), and 60-174879(1985). These surface-coated steel sheets have improved resistance to powdering since the organic coating does not contain metallic powder. However, their corrosion resistance still does not reach a satisfactory level.

Many attempts have been made to modify one or more of the plating, chromate, and organic coating layers of the above-described multilayer surface-coated steel sheets.

Japanese Patent Application Kokai No. 58-210192(1983) discloses a surface-coated steel sheet plated with a Ni-Zn alloy of the $\gamma$ single phase containing 9–20 wt % Ni and having a chromate film and a conductive material-containing organic coating on the plating layer. Japanese Patent Application Kokai No. 58-210190(1983) discloses a similar surface-coated steel sheet in which the plating layer is a duplex plating consisting of a lower $\gamma$-phase Ni-Zn alloy layer and an upper Fe-Zn alloy plating containing 10–40 wt % Fe.

Japanese Patent Application Kokai No. 61-84381(1986) describes a surface-coated steel sheet plated with a $\eta$-phase Ni-Zn alloy containing 1–3 wt % Ni and having thereon a chromate film and a polymer coating.

Japanese Patent Application Kokai No. 63-203778(1988) describes a surface-coated steel sheet plated with a zinc or zinc alloy in which fine particles of an insoluble metal compound such as an oxide, carbide, nitride, boride, phosphide, or sulfide of Si, Al, Fe, or the like are dispersed in order to modify the properties of the plating layer and which has a chromate film and an organic coating layer on the plating.

Japanese Patent Application Kokai No. 62-268635(1987) describes a surface-coated steel sheet having a zinc-based plating layer, a colloidal silica-containing chromate film, and a thin clear film of a polyhydroxypolyether resin which may contain a chromate pigment. Japanese Patent Application Kokai No. 1-80522(1989) discloses a similar surface-coated steel sheet in which the uppermost clear film is formed from a coating composition based on an epoxy or modified epoxy resin and containing at least one additive selected from inorganic fillers and cross-linking agents.

These various modifications of one or more of the layers proposed in the prior art can improve the corrosion resistance of surface-coated, weldable steel sheets for use as automobile panels. However, the improved corrosion resistance is mainly intended to increase resistance to perforative corrosion which occurs on a bare plated surface having no paint coating. Therefore, the above-mentioned type of surface-coated steel sheets having an inorganic-organic composite coating have been used for inner panels of automobiles which are usually partially covered with a paint coating. The cosmetic corrosion resistance of such surface-coated steel sheets after it has been covered with a paint coating is not satisfactory if the paint coating is injured.

As the requirements for corrosion resistance of automobile panels become stricter, it has been attempted to employ surface-coated steel sheets not only as inner panels but also as outer panels in automobiles. Automobile outer panels which are completely covered with a surface paint coating which is typically performed by electrodeposition coating of a primer followed by intercoating of a surfacer and topcoating are often injured accidentally, for example, by a hit of pebbles or chippings and hence they are required to withstand corrosion even if the surface paint coating is chipped or otherwise injured. Therefore, they must have good resistance to cosmetic corrosion which occurs in chipped areas of outer panels, i.e., those areas in which the surface coating is chipped off.

Recently, cosmetic corrosion resistance in chipped areas has become a requisite property for automobile inner panels as well, since they are usually covered with a paint coating at least partially and the coating may possibly be injured or chipped during conveying, transportation, and press-forming. Therefore, cosmetic corrosion resistance also contributes to improved corrosion resistance in automobile inner panels.

Accordingly, there is an extensive demand for surface-coated steel sheets having improved resistance to corrosion, particularly to cosmetic corrosion in chipped areas.

SUMMARY OF THE INVENTION

An object of the present invention is to provide a surface-coated steel sheet which is weldable, has a coating with good adhesion, and exhibits improved corrosion resistance even if the coating is chipped off.

Another object of the invention is to provide a surface-coated steel sheet which has a satisfactory resistance to perforative corrosion, cosmetic corrosion in chipped areas, and corrosion on its edge faces.

A further object of the invention is to provide an improved corrosion-resistant, surface-coated steel sheet which is suitable for use as both inner and outer panels of automobiles.

A surface-coated steel sheet having a plating layer, a chromate film layer, and an organic coating layer in which the plating layer is formed from a zinc alloy with one or two of Ni and Co having a content of the alloying element(s) low enough to form the $\eta$ or $(\eta+\gamma)$ phase exhibits good corrosion resistance, particularly with respect to cosmetic corrosion in chipped areas. However, such a surface-coated steel sheet does not have satisfactory adhesion of the plating layer to the chromate film and its corrosion resistance in flat areas and worked areas is rather poor.

It has been found that these problems can be overcome by overlaying the plating layer with a thin layer of a second zinc alloy plating having a higher content of the alloying element(s) (Ni and/or Co ).

The present invention provides a surface-coated steel sheet having improved corrosion resistance, comprising a steel sheet having on at least one surface thereof an inorganic-organic composite coating which comprises the following layers (a) to (d) from the bottom to the top of the coating:

(a) a first zinc alloy plating layer with a coating weight of 10–100 g/m$^2$ which contains at least one of nickel (Ni) and cobalt (Co) as an alloying element in an amount satisfying the following inequality:

$$0.05 \leqq (5 \times Co) + Ni \leqq 10 \quad \text{(in weight percent)},$$

(b) a second zinc alloy plating layer with a coating weight of 0.05–10 g/m$^2$ which contains at least one of Ni and Co as an alloying element in an amount satisfying the following inequality:

$$10 < 5 \times Co + Ni \leqq 40 \quad \text{(in weight percent)},$$

(c) a chromate film layer with a coating weight of 20–300 mg/m$^2$ as Cr, and (d) an organic coating layer with a thickness of 0.2–5 $\mu$m.

BRIEF DESCRIPTION OF THE DRAWINGS

FIGS. 1(*a*) to 1(*d*) schematically show cross-sections of different embodiments of the surface-coated steel sheets of the present invention;

DETAILED DESCRIPTION OF THE INVENTION

Figure 2:
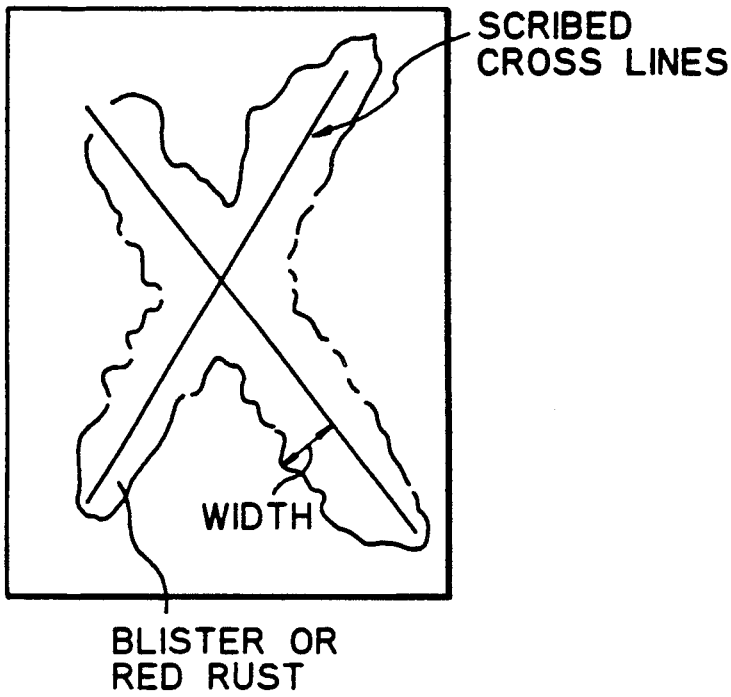
FIG. 2 schematically shows a test piece having scribed cross lines after an accelerated corrosion test.

The present invention will now be described in detail. In the following description, all the percents and parts are by weight unless otherwise indicated.

The base steel sheet of a surface-coated steel sheet of the present invention may be any type of steel sheet, but it is usually a cold-rolled steel sheet. A bake-hardenable steel sheet can be used advantageously since the resulting surface-coated steel has an increased mechanical strength.

As shown in FIGS. 1(*a*) to 1(*d*), the base steel sheet 1 has a composite coating comprising a first low alloy Zn plating layer 2, a second high Zn alloy plating layer 3, a chromate layer 4, and an organic coating layer 5 on at least one surface thereof.

First Plating Layer

The first (lower) plating layer is formed from a Zn alloy which contains at least one of Ni and Co as an alloying element in an amount satisfying the inequality:

$$0.05 \leqq (5 \times Co) + Ni \leqq 10 \quad \text{(in weight percent)},$$

and has a coating weight of 10–100 g/m$^2$.

The first plating layer which is a low alloy Zn plating can exert a sacrificial corrosion-preventing effect for a prolonged period. A eutectoid of Co with Zn stabilizes a corrosion product of Zn, i.e., $ZnCl_2 \cdot Zn(OH)_2$ and further improves the corrosion resistance. Therefore, Co is effective in smaller amounts than is Ni. However, the presence of Ni has another advantage in that the spot weldability of the surface-coated steel sheet is improved, thereby increasing the maximum number of weld spots attainable in continuous spot welding.

For this purpose, up to 13% Ni and preferably up to 10% Ni or up to 15% Co and preferably up to 2% of Co may be added to the first plating layer. However, since the presence of a large amount of Ni or Co may adversely affect other properties, the upper limit of the content of these elements is restricted as above.

When the Ni and/or Co content of the first zinc alloy plating layer is such that the value for $(5\times Co)+Ni$ is less than 0.05%, the dissolution rate of the layer is too fast to provide a corrosion-preventing effect for a prolonged period. On the other hand, when the value for $(5\times Co)+Ni$ is more than 10%, the sacrificial corrosion-preventing effect of the layer is decreased to such a degree that corrosion of the underlying base steel sheet is accelerated by the local chemical cell action of the Ni and/or Co residue remaining after Zn has been dissolved out by corrosion. The presence of Ni and/or Co in such a higher proportion also hardens the resulting plating and deteriorates the press-formability.

Preferably the Ni and/or Co content of the first plating is in such a range that the value for $(5\times Co)+Ni$ is from 2% to 10%.

When the coating weight of the first plating layer is less than 10 g/m$^2$ the resistance to perforative corrosion and cosmetic corrosion in chipped areas is not improved to a satisfactory level. A coating weight of the first plating layer exceeding 100 g/m$^2$ degrades the press-formability and weldability of the surface-coated steel sheet and it is also disadvantageous from the viewpoint of economy. The coating weight is preferably in the range of from 10 to 50 g/m$^2$ and more preferably from 15 to 40 g/m$^2$.

The first plating layer may include microcracks in the lowermost stratum thereof adjacent to the base steel in order to further improve the impact-resisting adhesion of the composite coating. Preferably the microcracks have a width of from 0.01 to 0.5 μm and they occupy from 10% to 60% of the area of the first layer.

The microcracks can be formed in a conventional manner. For example, a base steel sheet is initially electroplated with a very thin layer of the first plating and then dipped in an electroplating solution having the same composition as that used in the first plating without electronic conduction, thereby causing the initially formed very thin electroplating layer to be microcracked. Thereafter, the electroplating is continued to form a first plating layer with a predetermined coating weight.

Second Plating Layer

The second (upper) plating layer is formed from a Zn alloy which contains at least one of Ni and Co in a larger amount than the first plating layer which satisfies the inequality:

$$10<(5\times Co)+Ni\leqq 40 \quad \text{(in weight percent)},$$

and has a very small coating weight of 0.05–10 g/m$^2$. Thus, the second layer is a so-called flash plating of a high Zn alloy plating.

The second zinc alloy layer of a higher Ni and/or Co content improves the adhesion of the first relatively thick zinc alloy plating to the chromate film. If the first layer is directly covered with a chromate film layer, the adhesion between these two layers is poor and the corrosion resistance of the surface-coated steel sheet is deteriorated. The second layer also serves to control the dissolution rate of the underlying first plating layer.

Therefore, the second layer improves the resistance to perforative corrosion and, as a result, the surface-coated steel sheet of the present invention possesses a satisfactory level of corrosion resistance in flat areas, worked areas, and edge faces in addition to the improved cosmetic corrosion resistance in chipped areas which is mainly supported by the first plating layer. This layer also improves the press-formability since the sliding properties of the surface are improved.

When the Ni and/or Co content of the second zinc alloy plating layer is such that the value for $(5\times Co)+Ni$ is 10% or less or when the coating weight of the second plating layer is less than 0 05 g/m$^2$, the adhesion between the plating layers and the chromate film and hence the corrosion resistance are not improved to a satisfactory degree.

On the other hand, when the value for $(5\times Co)+Ni$ of the second layer is greater than 40% or when the coating weight thereof is greater than 10 g/m$^2$, production costs are increased. Furthermore, the dissolution rate of the first plating layer is excessively increased and corrosion of the base steel sheet is accelerated on edge faces and in chipped areas, thereby eventually inhibiting the improvement in resistance to perforative corrosion by the first layer. As a result, the corrosion resistance becomes worse with respect to cosmetic corrosion in chipped areas, corrosion on edge faces, and perforative corrosion.

Preferably the value for $(5\times Co)+Ni$ of the second layer is between 11% and 30% and the coating weight thereof is in the range of from 0.5 to 10 g/m$^2$. However, when the second layer has a relatively low alloying element content, the coating weight may be increased to up to 20 g/m$^2$. Also it is preferable that the total coating weight of the first and second plating layers be in the range of from 10.5 to 40 g/m$^2$. When the lower plating contains a relatively large amount of Co, the upper layer may contain 8%–16% Ni, preferably along with up to 6:4% of Co. Also when the alloying element present in the lower layer solely Co, the upper layer may be Ni-free and may contain from over 2% to 8% Co.

One or both of the first and second zinc alloy plating layers may optionally contain at least one metal oxide selected from the group consisting of $Al_2O_3$, $SiO_2$, $TiO_2$, $ZrO_2$, $PbO_2$, $Pb_2O_3$, $SnO_2$, SnO, $Sb_2O_5$, $Sb_2O_3$, $Fe_2O_3$, and $Fe_3O_4$ in an amount of not more than 10% and preferably not more than 5% as the metal content. These metal oxides, when present in a plating layer as a eutectoid, further improve the corrosion resistance of the layer.

It is preferable that these metal oxides, when used, have an average primary particle diameter of at most 2 μm and more preferably at most 0.5 μm in order to avoid agglomeration of the particles to form excessively coarse agglomerates.

Similarly, one or both of the first and second zinc alloy plating layers may optionally contain at least one additional alloying element selected from the group consisting of Al, Si, Nb, Mn, Mg, Mo, Ta, Cu, Sn, Sb, Ti, Cr, Cd, Pb, Tl, In, V, W, P, S, B, and N. The content of the additional alloying element should be smaller than the Ni and/or Co content of that layer. The addition of these alloying elements may improve certain properties of the surface-coated steel sheet.

It is also possible for one or both of the first and second plating layers to be comprised of a duplex plating layer.

The first and second plating layers can be formed by any suitable plating method including electroplating, galvanizing, flame spraying, and dry processes.

Chromate Film Layer

The chromate film layer is formed on the second plating layer with a coating weight of 20–300 mg/m$^2$ as Cr. It is highly effective for preventing corrosion, particularly perforative corrosion of a steel sheet. When the coating weight is less than 20 mg/m$^2$ the desired improvement in corrosion resistance is not adequate and it is difficult to form a uniform electrodeposited coating in the subsequent paint coating process. A coating weight of the chromate film exceeding 300 mg/m$^2$ causes a deterioration in spot weldability and electrodeposition coatability. Preferably the coating weight of the chromate film layer is in the range of from 30 to 300 mg/m$^2$ and more preferably from 50 to 150 mg/m$^2$ as Cr.

The chromate film layer may be formed from a chromating solution of the reaction type or of the electrolytic type, but preferably it is formed from a chromating solution of the coating type.

Also it is preferable that the chromating solution of the coating type be initially partially reduced such that the ratio of $Cr^{3+}$ ion content to total Cr ion content of the solution is in the range of from 0.2 to 0.6 in order to form the desired chromate film efficiently.

Various additives may be present in the chromating solution, particularly in the partially reduced chromating solution.

For example, the chromating solution may contain silica particles such as colloidal silica and fumed silica in an amount of 0.1 to 4 times and preferably 0.2 to 2 times the total weight of chromic acids (reduced and unreduced chromic acids) in order to improve corrosion resistance. However, since silica tends to degrade the spot weldability of the surface-coated steel sheet, the amount of silica, when it is added, should be selected carefully so as to avoid a significant deterioration in spot weldability.

Another additive which can be present in the chromating solution is iron phosphide. Iron phosphide improves the adhesion of the chromate film due to its reactivity with soluble $Cr^{6+}$ ions remaining in the film and also facilitates spot welding and electrodeposition coating of the surface-coated steel sheet due to its electrical conductivity. For this purpose, the chromating solution may contain iron phosphide in an amount of from 0.1 to 20 times and preferably from 0.1 to 10 times the total weight of chromic acids.

The chromating solution also may contain a difficultly-soluble chromate pigment in an amount of 0.! to 1 times and preferably 0.2 to 0.8 times the total weight of Cr ions ($Cr^{3+}$ and $Cr^{6+}$ ions) in order to further improve corrosion resistance. Examples of such pigments are barium chromate, strontium chromate, and lead chromate. They are also known as rust-preventive pigments.

A silane coupling agent may be added to the chromate solution in an amount of at least 0.01 moles and preferably at least 0.1 moles and not greater than 2 moles for each mole of unreduced chromic acid remaining in the solution. The silane coupling agent is hydrolyzed in the chromate solution to form a polysiloxane, thereby strengthening the resulting chromate film and improving the adhesion of the chromate film to the overlying organic coating layer. The alcohol liberated by hydrolysis of the silane coupling agent serves as a reducing agent for chromic acid. The addition of a silane coupling agent in an excessively large amount is disadvantageous since it adds to the production costs and may decrease corrosion resistance and electrodeposition coatability.

Examples of useful silane coupling agents include vinyltriethoxysilane, vinyl-tris(β-methoxyethoxy)silane, γ-methacryloxypropyltrimethoxysilane, γ-glycidoxypropyltrimethoxysilane γ-aminopropyltriethoxysilane N-(β-aminoethyl)-γ-aminopropyltrimethoxysilane, and β-(3,4-epoxycyclohexyl)ethyltrimethoxysilane.

A small amount of phosphoric acid may also be added to the chromating solution.

An additional reducing agent can be added to the partially reduced chromating solution in an amount of from 0.02 to 4 equivalents for each mole of unreduced chromic acid remaining in the solution to accelerate reduction and film formation of the chromate wet coating during baking. It is preferable to use one or more reducing agents selected from polyhydric alcohols such as ethylene glycol, propylene glycol, and glycerol, polycarboxlic acids such as succinic acid, glutaric acid, and adipic acid, and hydroxycarboxylic acids such as citric acid and lactic acid. The additional reducing agent is preferably added immediately before use since it tends to cause gelation of the chromating solution in a relatively short period.

Organic Coating Layer

The chromate film is covered with an organic coating layer in order to prevent the chromate film from dissolving out during alkali degreasing and phosphate treating to which a surface-coated steel sheet is usually subjected prior to paint coating. Therefore, in the absence of the overlying organic coating layer, the chromate film cannot exert its effect on improvement in corrosion resistance and hence the organic coating layer is necessary to maintain the desired corrosion resistance of the surface-coated steel sheet.

The organic coating layer also serves as a lubricating coating and facilitates press-forming of the surface coated steel sheet. Therefore, in most cases, there is no need to apply a lubricant prior to press-forming. Since the organic coating layer is very thin, it does not produce a significant loss in spot weldability.

The organic coating layer is formed with a thickness of from 0.2 to 5 μm. When it has a thickness of less than 0.2 μm, the desired effect on corrosion resistance cannot be attained sufficiently. A thick organic coating layer having a thickness of greater than 5 μm interferes with spot welding and electrodeposition coating due to the dielectric nature of the layer. Preferably the organic coating layer has a thickness in the range of from 0.2 to 2.5 μm and more preferably from 0.3 to 2.0 μm.

The organic coating layer may be formed from coating compositions based on various resins including polyester resins, melamine resins, vinyl resins, styrene resins, polyurethane resins, phthalic resins, and the like. Preferably it is formed from a coating composition based on a resin selected from the group consisting of epoxy resins, modified epoxy resins, polyhydroxypolyether resins, acrylic resins,.and modified acrylic resins.

Useful epoxy resins are the common polyglycidyl ether type resin derived by reaction of a polyhydric phenol such as bisphenol-A, bisphenol-F, or a novolac with an epihalohydrin.

Modified epoxy resins include epoxyester resins modified by reaction with a fatty acid of a drying oil, urethane-modified epoxy resins modified by reaction with an isocyanate, and epoxy acrylates modified by reaction with acrylic or methacrylic acid.

Useful acrylic resins include copolymers of two or more of acrylic and methacrylic acids and esters of these acids. Modified acrylic resins include those modified with an epoxy compound.

These resins preferably have a molecular weight of at least 1000 such that film formation can occur by baking at a relatively low temperature.

Another preferable resin for forming the organic coating layer is a polyhydroxypolyether resin which is prepared by a polymerization reaction of a dihydric phenol such as resorcinol, hydroquinone, catechol, and bisphenol-A with a nearly equimolar amount of an epihalohydrin in the presence of an alkali catalyst and which typically has a relatively high molecular weight in the range of 8,000 to 50,000. A suitable polyhydroxypolyether resin derived from bisphenol A and epichlorohydrin is sold by Union Carbide under the tradename "Phenoxy Resin PKHH".

It is more preferable that the polyhydroxypolyether resin be prepared from a dihydric phenol which predominantly comprises a single-nucleus dihydric phenol such as resorcinol, hydroquinone, and catechol. Such a polyhydroxypolyether resin forms a coating film containing an increased amount of functional groups such as —OH and —O— which contribute to improvement of the adhesion and flexibility of the coating film.

The coating composition used to form the organic coating layer may further contain a cross-linking agent in such an amount that the number of cross-linkable functional groups in the agent is from 0.1 to 2.0 times the total number of epoxy, hydroxyl, and carboxyl groups in the resin, and/or an inorganic filler in an amount of from 1% to 40% based on the weight of the resin.

When the coating composition is based on an acrylic resin or a modified acrylic resin containing at least one oxidatively cross-linkable carbon-carbon double bond in the molecule, there is no need to add a cross-linking agent, but the composition may contain an inorganic filler in an amount of from 1% to 40% based on the weight of the resin.

The addition of a cross-linking agent further improves the corrosion resistance of the surface-coated steel sheet. However, if it is added in an excessively large amount, the resulting organic coating layer becomes too stiff, leading to a loss of press-formability. Examples of useful cross-linking agents are phenolic resins, amino resins, polyamides, amines, blocked isocyanates, and acid anhydrides for epoxy, modified epoxy, and polyhydroxypolyether resins; and epoxy compounds for acrylic and modified acrylic resins.

The addition of an inorganic filler is also effective in further improving corrosion resistance. Useful inorganic fillers include colloidal silica, fumed silica; zinc phosphate, calcium phosphate, zinc phosphomolybdate, conductive pigments such as zinc powder and iron phosphide, and rust-preventive pigments as described above. If too much filler is added, the electric resistivity of the composite coating is increased, thereby adversely affecting the spot weldability. When silica is added, a silane coupling agent may be added along with the silica to improve the adhesion of the silica particles to the resin.

Other additives which can be added to the coating composition based on an organic resin in minor amounts include color pigments, waxes for improving lubricating properties of the coating, flexible resins such as butyral resins which serve as a plasticizer, water-soluble resins such as polyvinyl alcohols, polyacrylic acids, and polyacrylamides, and other resins.

The organic coating layer is usually a clear layer, but it may be colored with a color pigment if desired.

The chromating solution and the organic coating composition can be applied by any conventional method including roller coating, bar coating, dip coating, and spray coating. The wet coating of these solutions is then dried by baking. When the base steel sheet is bake-hardenable, it is preferable that the chromate film layer and the organic coating layer be both formed by baking at temperatures below 200° C.

In one embodiment of the present invention, the surface-coated steel sheet has the inorganic-organic composite coating on both surfaces thereof, as shown in FIG. 1(*a*).

In another embodiment, the surface-coated steel sheet has the inorganic-organic composite coating on one surface and the other surface of the steel sheet has a different coating. In most cases, the surface having the inorganic-organic composite coating is usually the interior surface of the product and the other surface having a different coating is usually the exterior surface and is usually overlaid with a paint.

A first example of the coating which can be applied to the other surface of the steel sheet is shown in FIG. 1(*b*). This coating is a duplex plating comprising a first or lower layer 6 of zinc or a zinc alloy containing at least one of Ni and Co in an amount as defined in (a) above and a second or upper layer 7 of a zinc alloy containing at least one of Ni and Co in an amount as defined in (b) above. After the duplex plating is coated with a paint, the other surface exhibits good corrosion resistance even if the paint is chipped off. The coating weight of each of the upper and lower plating layers is preferably in the same range as the corresponding layer of the inorganic-organic composite coating.

A second example of the coating on the other surface is shown in FIG. 1(*c*) which consists of a lower plating layer 8 and an upper removable solid lubricating coating layer 9. The plating layer is comprised of either a single plating of zinc or a zinc alloy containing at least one of Ni and Co in an amount as defined in (a) above or a duplex plating just described for the first example. The coating weight of the single plating layer is preferably in the same range as the first plating layer in the inorganic-organic duplex plating and that of each layer of the duplex plating is in the same range as the corresponding layer of the inorganic-organic composite coating.

The upper lubricating coating layer serves to decrease the resistance to sliding of the surface and facilitates press-forming of the surface-coated steel sheet without cracking of the surface coating, particularly in the case where the lower layer is the above-described single plating layer, since such a plating layer is relatively soft and its press-formability is rather poor due to the precipitation of $\eta$-phases in the plated coating.

The solid lubricating coating layer can be prepared by applying a coating composition which comprises a curable film-forming resin and at least one lubricant. Examples of useful resins are acrylic resins, epoxy resins, melamine resins, phenolic resins, and similar resins which can form a cured film by drying or baking. It is preferable that the resin have a relatively high acid value such that the resulting lubricating coating can be readily removed by treatment with an alkaline solution which is usually employed in a degreasing treatment before painting.

Useful lubricants include fatty acids, fatty acid esters, fatty acid soap, metallic soap, alcohols, polyethylene fine powder, graphite, molybdenum disulfide, fluoroplastic powder, and the like.

The thickness of the lubricating layer is preferably in the range of from 0.5 to 3 μm. After the steel sheet is press-formed, the lubricating layer should be removed completely by a degreasing treatment which is performed prior to painting or other chemical or mechanical means.

A third example of the coating on the other surface is shown in FIG. 1(*d*) which consists of a lower plating layer 10 and an upper zinc phosphate coating layer 11. Like the second example, the plating layer comprises either a single plating of zinc or a zinc alloy containing at least one of Ni and Co in an amount as defined in (a) above or a duplex plating as described above for the first example. The coating weight of the single or duplex plating layer is preferably as described above for the second example.

Like the lubricating coating, the zinc phosphate coating serves to decrease the resistance to sliding and improves the press-formability. The coating weight is preferably in the range of from 0.1 to 5 g/m$^2$. The zinc phosphate coating layer can be formed by a conventional phosphating treatment.

As described previously, the surface-coated steel sheet is particularly suitable for use as automobile inner and outer panels. However, it can find other applications such as building panels, appliance covers, and the like.

The following examples are presented as specific illustrations of the claimed invention. It should be understood, however, that the invention is not limited to the specific details set forth in the examples.

EXAMPLE 1

Surface-coated steel sheets were prepared by treating a 0.8 mm-thick cold-rolled steel sheet in the following sequence:

Alkali degreasing→pickling (electrolysis in sulfuric acid or dipping in hydrochloric acid)→thin electroplating with a low Ni-Zn alloy→dipping in an electroplating solution without electronic conduction→first electroplating with a low Ni-Zn alloy→second electroplating with a high Ni-Zn alloy→water rinsing and drying→chromate treatment→baking→application of an organic coating layer→baking.

Each of the first and second electroplated layers was formed on both surfaces using a sulfate electroplating bath containing 20–70 g/l of $Zn^{2+}$, 0–60 g/l of $Ni^{2+}$, and 50 g/l of $Na_2SO_4$. The pH of the plating bath was about 2 and the temperature thereof was 50° C. The Ni content of each electroplated layer was adjusted by varying the $Zn^{2+}$ and $Ni^{2+}$ concentrations of the electroplating solution, while the coating weight thereof was adjusted by varying the quantity of electricity passed.

After water rinsing and drying, some of the resulting duplex-electroplated steel sheets were roll-coated on one surface thereof with a chromate film and a clear organic coating layer in the manner described below. The other electroplated steel sheets had no overlying layers of a chromate film and an organic coating in order to evaluate the properties of the duplex plating layers.

The chromate film was formed from a coating-type chromating solution and the organic coating layer was formed from an epoxy resin-based clear coating composition. The coating weight or thickness of these layers was controlled by varying the circumferential speeds of the pickup and/or applicator rolls of the roll coater and the contact pressure between these two rolls and/or by varying the concentration of the chromating solution or the clear coating composition.

The resulting surface-coated steel sheets, each having an inorganic-organic composite coating on one surface were evaluated for resistance to cosmetic corrosion and perforative corrosion, sliding properties in press-forming, electrodeposition coatability, and spot weldability in the manner described below. These properties were evaluated on the surface of the composite coating on each test piece. Similarly, duplexelectroplated steel sheets were also evaluated for these properties except for perforative corrosion resistance.

Cosmetic Corrosion Resistance

The coating surface of a test piece was subjected sequentially to zinc phosphating, cationic electrodeposition coating to a thickness of 20 μm, and intercoating and topcoating both with a melamine-alkyd resin to a thickness of 35 μm to give a painted test piece. The paint coating was injured by scribing a cross to a depth sufficient to reach the base steel sheet and the test piece was exposed to the outdoors for a year while being sprayed with a 5% NaCl solution twice a week. As shown in FIG. 2, the cosmetic corrosion resistance was evaluated in terms of the width of blistered coating formed along the scribed cross lines, i.e., the maximum creep width on either side from the lines.

Perforative Corrosion Resistance

The back surface (plated surface) and the edge surfaces of a test piece having no paint coating were sealed with polyester tape and the test surface having a composite coating was subjected to an accelerated perforating corrosion test with a 24 hour-cycle which consisted of salt spraying for 6 hours, drying at 50° C. for 2 hours, and humidifying at 50° C. and a relative humidity of 95% for 16 hours.

After 200 cycles, the perforative corrosion resistance was evaluated by measuring the maximum depth of corroded perforations using a point micrometer.

Sliding properties in Press-Forming

Figure 3:
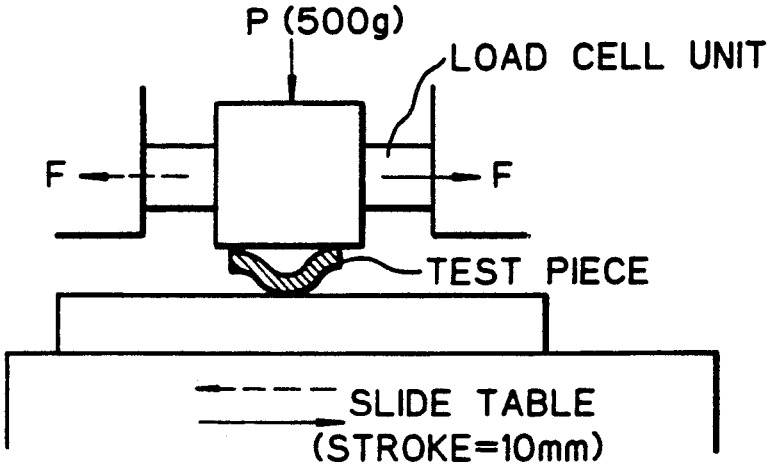
FIG. 3 is a schematic illustration of a modified Bauden test.

The sliding properties of the coated surface of a test piece in contact with a tool surface of a press were evaluated by determining the coefficient of friction of the coated surface according to a modified Bauden test shown in FIG. 3. A lubricating oil having a viscosity of 8 centistoke at 40° C. was applied to the tool surface on the sliding table which was brought into contact with the test piece.

Electrodeposition Coatability

The inorganic-organic composite coating of a surface-coated steel sheet of the present invention should have a good electrodeposition coatability even if it faces inside since the interior surfaces of some automobile panels such as trunk lids and hoods are exposed when they are opened.

After the electrodeposition coating performed in the cosmetic corrosion resistance test, the coated surface of the test piece was visually observed and the electrodeposition coatability was evaluated as follows:

◎: excellent; ○: good; Δ: fair; X: poor; XX: bad.

Spot Weldability

The spot weldability was tested by performing continuous spot welding at a rate of 20 spots per minute under the following conditions: welding force=200 kg-f, squeeze time=20 cycles, weld time=10 cycles, retention time=15 cycles, and welding current=11 kA. The spot weldability was evaluated by the number of spots before the nugget diameter decreased to 4°t(=3.6 ram) [where t is the thickness of the base steel sheet (=0.8 mm)], which was considered the point at which continuous spot welding was no longer successful.

The results of these tests are summarized in Table 1 along with the details of each layer of the surface-coated steel sheets. In Table 1 and the following tables, those runs identified by alphabetical marks are comparative runs.

EXAMPLE 2

A 0.8 mm-thick cold-rolled Al-killed steel sheet which had been pretreated by solvent degreasing, electrolytic degreasing, water rinsing, pickling in a hydrochloric acid solution, and water rinsing was subjected to duplex electroplating, chromating, and coating with an organic coating layer in the following manner.

Duplex Plating

Duplex plating of the pretreated steel sheet was performed on both surfaces of the sheet by a sequence of electroplating with a Zn-Co or Zn-Ni-Co alloy to form a lower layer, water rinsing, electroplating with a Zn-Co, Zn-Ni, or Zn-Ni-Co alloy to form an upper layer, and water rinsing.

In comparative runs, one or both of the plating layers were formed from a Zn-Fe alloy or Zn or Fe metal or the plating comprised a single Zn-Co plating layer.

The electroplating was performed using the following conditions:

| | | |
|---|---|---|
| Composition of plating solutions: | | |
| 1) | Zn—Co alloy plating solutions | |
| | 200–400 g/l of $ZnSO_4.7H_2O$ | |
| | 50–400 g/l of $CoSO_4.7H_2O$ | |
| | 60–100 g/l of $Na_2SO_4$. | |
| 2) | Zn—Ni alloy plating solutions | |
| | 200–400 g/l of $ZnSO_4.7H_2O$ | |
| | 50–400 g/l of $NiSO_4.7H_2O$ | |
| | 60–100 g/l of $Na_2SO_4$. | |
| 3) | Zn—Fe alloy, Fe, and Zn plating solutions | |
| | 0–400 g/l of $ZnSO_4.7H_2O$ | |
| | 0–500 g/l of $FeSO_4.7H_2O$ | |
| | 60–100 g/l of $Na_2SO_4$. | |
| Electroplating conditions: | | |
| Temperature of plating bath: | | 40–60° C. |
| Flow rate of plating solution: | | 0.5–3 m/sec |
| Current density: | | 40–120 A/dm$^2$. |

Addition of third component

A third metallic component, when present, was added to the plating bath in the form of a sulfate, carbonate, chloride, molybdate, pyrophosphate, hypophosphite, or organometallic compound of the metal or a solution of the metal in an acid.

A plating layer in which a metal oxide was precipitated was formed by adding a sol of the metal oxide to the plating bath in an amount of 0.01–100 g/l. The metal content of the metal oxide which precipitated as a eutectoid in the plating coating was determined, after the plating coating was dissolved, by an ICP spectroscopic, atomic-absorption spectroscopic, or voltammetric method.

Chromating

The resulting steel sheet having a duplex plating coating on both surfaces was degreased with an alkali degreasing solution and then coated on one surface with a chromating solution using a bar coater and baked for 30 minutes at a sheet temperature of 140° C. to form a dry chromate film.

The chromating solution which was used was prepared as follows.

Ethylene glycol was added as a reducing agent to an aqueous chromic acid solution containing 120 g/l of $CrO_3$. The solution was then heated at 80° C. for 6 hours. Thereafter, an additional chromic acid solution was added in an amount sufficient to adjust the molar ratio of $Cr^{3+}$ ions to total Cr ions to a predetermined value shown in Table 2 and water was added in an amount sufficient to adjust the total chromic acid concentration to 40 g/l (=0.4 M) as $CrO_3$.

To the resulting partially-reduced chromate solution, glycerol was added as an additional reducing agent prior to use, optionally along with one or more of colloidal silica (Aerosil 130), iron phosphide (average particle diameter: 5 μm), and γ-glycidoxypropyltrimethoxysilane as a silane coupling agent.

Organic Coating

The following three resin solutions were used.

Resin Solution A: A powdery polyhydroxypolyether resin having a number-average molecular weight of 35,000 was prepared by reacting an equimolar mixture of resorcinol and bisphenol-A with epihalohydrin in the presence of 5N NaOH in methyl ethyl ketone for 18 hours at a reflux temperature and pouring the resulting resinous product in water for precipitation. The resin was dissolved in a mixed solvent of cellosolve acetate and cyclohexanone (1:1 by volume) to give a 20% solids solution, which was used as Resin Solution A.

Resin Solution B: A 20% solids solution of a commercially-available polyhydroxypolyether resin derived from bisphenol A (Phenoxy Resin PKHH sold by Union Carbide, MW=30,000) in the same mixed solvent as above.

Resin Solution C: A 20% solids solution of a commercially available epoxy resin (Epikote 1009 sold by Yuka-Shell Epoxy, MW=3750) in a mixed solvent of xylene and methyl ethyl ketone (6:4 by weight).

In some cases, one or more of colloidal silica (Oscal 1432 sold by Shokubai Kasei), a cross-linking agent (a blocked isocyanate for Resin Solutions A and B or a phenolic resin for Resin Solution C), a plasticizer (butyral resin), a conductive pigment ($Fe_2P$), and a rust-preventing pigment ($SrCrO_4$ or $BaCrO_4$) were added to the resin solution used.

The resin solution was bar-coated onto the chromate film and baked for 60 seconds at a sheet temperature of 140° C. to form a cured resin coating.

Testing Methods

The resulting surface-coated steel sheets were tested for corrosion resistance, wet paint adhesion, and chromium dissolution on the surface having the composite coating, and spot weldability in the following manner.

Corrosion Resistance

Three test pieces of a surface-coated steel sheet were used. Two were flat; of these one was intact and the other had scribed cross lines on the composite coating to a depth sufficient to reach the base steel. The other test piece was subjected to cup drawing with a diameter of 50 mm while the die shoulder was washed with trichloroethylene and ground with a #120 emery paper before each cup drawing so as to give a constant surface roughness.

After these test pieces were immersed in an alkali degreasing solution at 43° C. for two and a half minutes, washed with water, and then baked at 165° C. for 25 minutes, they were subjected to an accelerated corrosion test with a 8 hour-cycle consisting of salt spraying for 4 hours, hot air drying at 60° C. for 2 hours, and humidifying at 50° C. and a relative humidity of 5% for 2 hour.

For the intact flat and the cup-drawn test pieces, the corrosion resistance was evaluated after 200 cycles (1600 hours) by measuring the percent area on the flat test piece or on the side wall of the cup-drawn test piece which was covered by red rust. For the test piece having scribed cross lines, the corrosion resistance was evaluated by measuring the maximum width of red rust on either side from the scribed cross lines after 25 cycles (200 hours) as shown in FIG. 2.

Wet Paint Adhesion

The surface of a test piece having a chromate layer and an organic coating layer was coated with a 20 μm-thick epoxy-based cationic electrodeposition coating and then with a 10 μm-thick intercoating and 40 μm-thick topcoating both based on an aminoalkyd resin. These coatings are conventionally employed in painting of automobile outer panels.

After the resulting painted test piece was immersed in deionized water at 40° C. for 240 hours, it was subjected to a cross cut adhesion test in which 100 square sections were formed by cross cutting with 2-mm width. The test results were rated according to the number of square sections in which at least 30% of the coating had been removed by peeling with adhesive tape.

x: 5 or more square sections removed,

Δ: 1 to 4 square sections removed,

O: no square sections removed.

Chromium Dissolution

A test piece was immersed in an alkali degreasing solution (FC-L 4410, Nihon Parkerizing) at 43° C. for two and a half minutes and then in a zinc phosphating solution (PB-L 3080, Nihon Parkerizing) at 43° C. for 2 minutes. After each immersion, the amount of chromium dissolved out into the immersing solution was determined based on the Cr amount remaining on the test piece which was measured before and after the immersion by fluorescent X-ray analysis.

Weldability

Two test pieces were laid one on another with the organic-coated surfaces thereof facing each other and spot welding was performed on these test pieces using an AC single spot welder and electrode tips each having a tip diameter of 6.0 nun under the following conditions: 10,000 A welding current, 12 cycles weld time, and 200 kgf welding force. The weldability was evaluated in the following two respects A and B:

A. Stability of electrical conduction: After 1000 spots were welded, the indentations of 100 spots selected at random were visually observed as to whether they were stable (regular) or unstable (irregular). Unstable indentations are indications of occurrence of local current concentration. The results were evaluated as the number of spots having unstable indentations.

B. Diameter of electrode tips: After welding of 1000 spots, the diameters of the electrode tips were measured by pressing them on a sheet of pressure-sensitive paper and were evaluated as follows:

O: <7.0 mm, Δ: 7.0–8.0 mm, X: <8.0 mm.

The details of each layer and test results of the surface-coated steel sheets are shown in Table 2 and Table 3, respeetively. In Table 2, "$CrO_3$" indicates the weight of total Cr converted into the weight of $CrO_3$.

EXAMPLE 3

This example illustrates the properties of surface-coated steel sheets having a composite coating (duplex Ni-Zn alloy plating+chromate+organic coating) on one surface and a single Ni-Zn alloy plating overlaid with a solid lubricating coating on the other surface.

Following the procedure described in Example 1, 0.8 mm-thick steel sheets were electroplated on both surfaces with a single Ni-Zn alloy plating layer having a Ni content of not more than 10% or duplex Ni-Zn alloy plating layers in which the lower layer contains not more than 10% Ni and the upper layer contains more than 10% and at most 40% Ni.

After water rinsing and drying of the resulting electroplated steel sheets, those having a single low Ni-Zn alloy plating layer were then each coated on one surface thereof with a removable solid lubricating coating by applying a melamine-alkyd resin coating composition containing a fluoroplastic powder dispersed therein using a roll coater followed by baking. The thickness of the lubricating coating was adjusted by varying the circumferential speeds of the pickup and/or applicator rolls of the roll coater and the contact pressure between these two rolls and/or by varying the concentration of the fluoroplastic powder in the coating composition.

The resulting surface-coated steel sheet was tested on the surface having the solid lubricating coating with respect to the cosmetic corrosion resistance, sliding properties in press-forming, and electrodeposition coatability by the same testing procedures as described in Example 1.

Each of the other electroplated steel sheets having a duplex Ni-Zn plating layer was coated on one surface thereof with a chromate film and an organic coating layer in the same manner as described in Example 1. The resulting surface-coated steel sheet was tested on the surface having the chromate and organic coating layers with respect to the cosmetic and perforative corrosion resistance, sliding properties in press-forming, and electrodeposition coatability by the same testing procedures as described in Example 1.

The test results are summarized in Table 4 along with the details of the surface coatings.

EXAMPLE 4

This example illustrates the properties of a surface coating consisting of a single low Ni-Zn alloy plating having a Ni content of at most 10% and an overlying zinc phosphate coating, which surface coating can be formed on one surface of the surface-coated steel sheet of the present invention having a composite coating (duplex Ni-Zn alloy plating+chromate+organic coating) on the other surface.

Following the procedure described in Example 1, 0.8 mm-thick steel sheets were electroplated on both surfaces with a single Ni-Zn alloy plating layer. After water rinsing and drying, each of the resulting electroplated steel sheets was then spray-coated on one surface thereof with a zinc phosphating solution to form a zinc phosphate coating on the surface.

The resulting surface-coated steel sheet was tested on the surface having the zinc phosphating coating with respect to the cosmetic corrosion resistance, sliding properties in press-forming, and electrodeposition coatability by the same testing procedures as described in Example 1.

The test results are summarized in Table 5 along with the details of the surface coatings.

It can be seen from the results shown in Tables 1 to 5 that the surface-coated steel sheets having an inorganic-organic composite coating according to the present invention have good resistance to corrosion including cosmetic corrosion in chipped areas and perforative corrosion while retaining good electrodeposition coatability, spot weldability, press-formability, and coating adhesion, particularly impact-resisting adhesion.

Although the present invention has been described with respect to preferred embodiments, it is to be understood that variations and modifications may be employed without departing from the concept of the invention as defined in the following claims.

TABLE 1

| Run No. | First Ni—Zn plating % Ni | First Ni—Zn plating Weight (g/m²) | Second Ni—Zn plating % Ni | Second Ni—Zn plating Weight (g/m²) | Chromate film Weight as Cr (mg/m²) | Organic layer Thickness (μm) | Cosmetic Corrosion Resistance (mm) | Perforative Corrosion Resistance (mm) | Sliding properties (Coeff. of friction) | Electro-deposition coatability | Spot weldability (Maximum number of weld spots in continuous welding) |
|---|---|---|---|---|---|---|---|---|---|---|---|
| 1 | 7 | 10 | 13 | 5 | 100 | 1.0 | 2.8 | 0.05 | 0.10 | ○ | 6000 |
| 2 | | 20 | | | | | 1.2 | 0 | 0.10 | ○ | 7000 |
| 3 | | 30 | | | | | 0.8 | 0 | 0.10 | ○ | 6000 |
| 4 | | 40 | | | | | 0.6 | 0 | 0.10 | ○ | 7500 |
| 5 | | 50 | | | | | 0.5 | 0 | 0.10 | ○ | 6500 |
| 6 | 10 | 20 | 13 | | | | 1.6 | 0.07 | 0.10 | ○ | 6000 |
| 7 | | | 20 | | | | 2.0 | 0 | 0.10 | ○ | 2000 |
| 8 | | | 30 | | | | 2.5 | 0 | 0.10 | ○ | 6000 |
| 9 | | | 40 | | | | 3.2 | 0 | 0.10 | ○ | 7000 |
| 10 | | | 13 | | 30 | | 2.0 | 0.04 | 0.10 | ○ | 6500 |
| 11 | | | | | 50 | | 1.9 | 0.02 | 0.10 | ○ | 6300 |
| 12 | | | | | 150 | | 1.5 | 0 | 0.10 | ○ | 5500 |
| 13 | | | | | 225 | | 1.4 | 0 | 0.10 | ○ | 4200 |
| 14 | | | | | 300 | | 1.2 | 0 | 0.10 | Δ | 2700 |
| 15 | | | | | 100 | 0.3 | 1.8 | 0.07 | 0.18 | ◎ | 7500 |
| 16 | | | | | | 0.5 | 1.7 | 0 | 0.15 | ○ | 7000 |
| 17 | | | | | | 2 | 1.5 | 0 | 0.10 | ○ | 4600 |
| 18 | | | | | | 2.6 | 1.4 | 0 | 0.10 | Δ | 2900 |
| 19 | 0 | 20 | 13 | 5 | — | — | 0.5 | — | 0.19 | ◎ | ≧8000 |
| 20 | 3 | | | | — | — | 1.0 | — | 0.19 | ◎ | ≧8000 |
| 21 | 7 | | | | — | — | 1.4 | — | 0.19 | ◎ | ≧8000 |
| 22 | 10 | | | | — | — | 1.6 | — | 0.18 | ◎ | ≧8000 |
| 23 | 7 | 10 | | | — | — | 3.0 | — | 0.18 | ◎ | ≧8000 |
| 24 | | 30 | | | — | — | 0.8 | — | 0.19 | ◎ | ≧8000 |
| 25 | | 20 | 20 | | — | — | 1.7 | — | 0.17 | ◎ | ≧8000 |
| 26 | | | 40 | | — | — | 3.0 | — | 0.15 | ◎ | ≧8000 |
| 27 | | | 48 | | — | — | 5.8 | — | 0.15 | ◎ | ≧8000 |
| 28 | | | 15 | | — | — | 1.4 | — | 0.18 | ◎ | ≧8000 |
| 29 | | | 13 | 0.5 | 100 | 1.0 | 1.0 | 0.1 | 0.10 | ○ | 6000 |
| 30 | | | | 2 | | | 1.2 | 0.03 | 0.10 | ○ | 6500 |
| 31 | | | | 10 | | | 1.8 | 0 | 0.10 | ○ | 6000 |
| 32 | | | | 2 | — | — | 1.2 | — | 0.20 | ◎ | ≧8000 |
| 33 | | | | 0.5 | — | — | 1.1 | — | 0.22 | ◎ | ≧8000 |
| 34 | | | | 9 | — | — | 1.5 | — | 0.18 | ◎ | ≧8000 |
| A | 7 | 5* | 13 | 5 | 100 | 1.0 | 7 | Perforated | 0.10 | ○ | 6500 |
| B | | 0* | | | | | 8 | 0.4 | 0.10 | ○ | 6500 |
| C | 10 | 20 | 5* | | | | 0.8 | 0.5 | 0.10 | ○ | 6000 |
| D | | | 13 | | 15* | | 1.8 | 0.65 | 0.10 | ○ | 7500 |
| E | | | | | 100 | 0.1* | 1.6 | 0.55 | 0.10 | ◎ | 8000 |
| F | 18* | | | | — | — | 4 | — | 0.19 | ◎ | ≧8000 |
| G | 27* | | | | — | — | 6 | — | 0.18 | ◎ | ≧8000 |
| H | 7 | 6* | | | — | — | 6 | — | 0.19 | ◎ | ≧8000 |
| I | | 20 | 0* | | — | — | 0.7 | — | 0.39 | ◎ | 2000 |
| J | | | 8* | | — | — | 1.0 | — | 0.30 | ◎ | 2500 |
| K | 10 | | 13 | | 350* | 1.0 | 1.6 | 0 | 0.10 | X | 1000 |

*Outside the range defined in the present invention.

TABLE 2

| Run | First plating layer | Weight | Second plating layer | Weight | Chromate film: Initial reduction $Cr^{3+}$ | Chromate film: Glycerol Amount | Chromate film: Glycerol OH | Chromate film: $Cr^{6+}$ | Chromate film: Silica $SiO_2$ | Chromate film: $CrO_3$ |
|---|---|---|---|---|---|---|---|---|---|---|

TABLE 2-continued

| No. | Composition | ($g/m^2$) | Composition | ($g/m^2$) | total Cr | (g/l) | ratio | ratio |
|---|---|---|---|---|---|---|---|---|
| 1 | Zn—0.05Co | 20 | Zn—2.2Co | 10 | 0.4 | 15 | 2 | 1 |
| 2 | Zn—0.08Co | 85 | Zn—6Co—5Mn | 5 | 0.5 | 6 | 1 | 0 |
| 3 | Zn—0.17Co—0.9$SiO_2$ | 33 | Zn—7.9Co | 2 | 0.4 | 15 | 2 | 1 |
| 4 | Zn—0.3Co—0.2P | 20 | Zn—20Ni—7P | 4 | 0.4 | 15 | 2 | 1 |
| 5 | Zn—0.4Co | 23 | Zn—2.7Co—0.9Ni | 2 | 0.5 | 6 | 1 | 0 |
| 6 | Zn—0.6Co—1.2$Al_2O_3$ | 25 | Zn—13Ni | 6 | 0.4 | 15 | 2 | 1 |
| 7 | Zn—0.7Co—0.7S | 30 | Zn—7Co—3Ni | 0.05 | 0.4 | 15 | 2 | 1 |
| 8 | Zn—0.8Co | 10 | Zn—10.5Ni | 4 | 0.4 | 15 | 2 | 1 |
| 9 | Zn—0.8Co—1.1$Sb_2O_5$ | 30 | Zn—5.6Co—1.1$TiO_2$ | 0.8 | 0.4 | 15 | 2 | 1 |
| 10 | Zn—0.9Co—0.5Ni | 19 | Zn—2.6Co—0.9Mo | 3 | 0.5 | 6 | 1 | 0 |
| 11 | Zn—1Co | 24 | Zn—3.9Co—0.5$Sb_2O_5$ | 1.4 | 0.4 | 15 | 2 | 1 |
| 12 | Zn—1Co—0.2Mo | 23 | Zn—17Ni | 5 | 0.5 | 12 | 2 | 2 |
| 13 | Zn—1.1Co—0.9Cr | 20 | Zn—3.2Co | 3 | 0.4 | 15 | 2 | 1 |
| 14 | Zn—1.1Co—0.7Mn | 30 | Zn—4Co | 4 | 0.4 | 15 | 2 | 1 |
| 15 | Zn—1.2Co—0.5$Sb_2O_5$ | 12 | Zn—11Ni—6B | 3 | 0.4 | 15 | 2 | 1 |
| 16 | Zn—1.2Co | 20 | Zn—4.5Co—0.9$Sb_2O_5$ | 5 | 0.4 | 15 | 2 | 0 |
| 17 | Zn—1.3Co—0.2Cu—0.3$ZrO_2$ | 90 | Zn—3Co—9.4$SiO_2$ | 5 | 0.4 | 15 | 2 | 1 |
| 18 | Zn—1.3Co—0.9$TiO_2$—0.5$SiO_2$ | 25 | Zn—11Ni—3Co | 0.2 | 0.5 | 12 | 2 | 1 |
| 19 | Zn—1.4Co—0.8P—3.1$Fe_2O_3$ | 22 | Zn—2.2Co—1.9$Al_2O_3$ | 4 | 0.4 | 15 | 2 | 1 |
| 20 | Zn—1.5Co | 31 | Zn—15Ni—0.2$SiO_2$ | 2.5 | 0.4 | 15 | 2 | 1 |
| 21 | Zn—1.6Co—2.9$SnO_2$ | 28 | Zn—9Ni—2Co—1Tl—0.3$Fe_2O_3$ | 1 | 0.5 | 12 | 2 | 1 |
| 22 | Zn—1.8Co | 15 | Zn—7Co—3S | 3 | 0.4 | 15 | 2 | 1 |
| 23 | Zn—1.9Co—8.2$TiO_2$ | 98 | Zn—5.9Co | 2 | 0.5 | 12 | 2 | 2 |
| 24 | Zn—0.7Co | 23 | Zn—4Co—3Ni | 2 | 0.4 | 15 | 2 | 1 |
| 25 | Zn—0.4Co—0.4Ni | 15 | Zn—12Ni—3Mo | 0.4 | 0.4 | 15 | 2 | 1 |
| 26 | Zn—0.9Co—0.1$SnO_2$ | 19 | Zn—5Co—1.4$TiO_2$ | 7 | 0.5 | 12 | 2 | 2 |
| 27 | Zn—1.1Co | 28 | Zn—4Co | 3 | 0.4 | 15 | 2 | 1 |
| 28 | Zn—0.4Co—0.2B | 26 | Zn—3Co—3Ni | 1.1 | 0.4 | 15 | 2 | 0 |
| 29 | Zn—1.7Co—0.6Sn | 13 | Zn—2.5Co—0.5Sn | 5 | 0.4 | 15 | 2 | 1 |
| 30 | Zn—0.9Co—0.9Cr | 30 | Zn—2.2Co—0.7$Sb_2O_5$ | 4 | 0.5 | 12 | 2 | 1 |
| 31 | Zn—5.3Ni—0.8Co | 21 | Zn—12Ni | 6 | 0.25 | 15 | 2 | 1 |
| 32 | Zn—0.7Co—0.7Ni | 24 | Zn—9Ni—4Co | 4 | 0.32 | 15 | 2 | 1 |
| 33 | Zn—0.04Ni—0.02Co | 26 | Zn—17Ni—1Co | 5 | 0.35 | 15 | 2 | 1 |
| 34 | Zn—1.5Ni—1.1Co—0.5$Sb_2O_5$ | 25 | Zn—3Co | 3 | 0.3 | 15 | 2 | 1 |
| 35 | Zn—3.2Ni—1.3Co | 20 | Zn—10Ni—0.5Co | 8 | 0.4 | 15 | 2 | 1 |
| A | Zn* | 50 | Zn—10.5Ni | 2 | 0.4 | 15 | 2 | 1 |
| B | Zn—13Fe* | 40 | Zn—6Co—3$TiO_2$ | 4 | 0.4 | 15 | 2 | 1 |
| C | Zn—17Fe* | 35 | Zn—15Ni | 3 | 0.4 | 15 | 2 | 1 |
| D | Zn—30Ni* | 30 | Zn—10Co | 1 | 0.4 | 15 | 2 | 1 |
| E | Zn—12Ni* | 40 | Zn—8Co | 3 | 0.4 | 15 | 2 | 1 |
| F | Zn—5Co* | 30 | Zn—11Ni | 2 | 0.4 | 15 | 2 | 1 |
| G | Zn—1.4Co | 25 | —* | —* | 0.4 | 15 | 2 | 1 |
| H | Zn—0.6Co | 30 | Fe* | 4 | 0.4 | 15 | 2 | 1 |
| I | Zn—1.7Co | 35 | Zn—0.5Co* | 2 | 0.4 | 15 | 2 | 1 |
| J | Zn—0.7Co | 40 | Zn—7Ni* | 3 | 0.4 | 15 | 2 | 1 |
| K | Zn—1.6Co | 25 | Zn—7Co | 0.01* | 0.4 | 15 | 2 | 1 |
| L | Zn—0.2Co | 30 | Fe—15Zn* | 5 | 0.4 | 15 | 2 | 1 |
| M | Zn—1.7Co | 30 | Ze—3Co | 3 | 0.4 | 15 | 2 | 1 |
| N | Zn—0.1Co | 25 | Zn—19Ni | 5 | 0.4 | 15 | 2 | 1 |
| O | Zn—1.3Co | 15 | Zn—5Co | 2 | 0.4 | 15 | 2 | 1 |
| P | Zn—0.5Co—14$TiO_2$* | 25 | Zn—3.5Co | 3 | 0.4 | 15 | 2 | 1 |
| Q | Zn—1.4Co | 23 | Zn—13Ni—13$Al_2O_3$* | 4 | 0.4 | 15 | 2 | 1 |

| | Chromate film | | | Resin coating | | | | | | |
|---|---|---|---|---|---|---|---|---|---|---|
| | $Fe_2P$/$Fe_2P$ $CrO_3$ ratio | Coupling agent (g/l) | Coating weight as Cr ($mg/m^2$) | Resin type | Silica added (wt %) | Cross-linking[2)] agent Type | Cross-linking[2)] agent Amount (molar ratio) | Other additive Class | Other additive wt % | Film thickness (μm) |
| 1 | 0 | 0 | 60 | A | 15 | A | 0.5 | — | — | 1.3 |
| 2 | 0 | 0 | 60 | B | 0 | A | 0.5 | $Fe_2P$ | 75 | 5.0 |
| 3 | 3 | 10 | 100 | A | 15 | A | 0.5 | — | — | 1.6 |
| 4 | 0 | 0 | 60 | A | 15 | A | 0.5 | — | — | 1.3 |
| 5 | 0 | 0 | 60 | B | 0 | A | 0.5 | $Fe_2P$ | 75 | 2.1 |
| 6 | 3 | 10 | 60 | A | 10 | A | 0.5 | $SrCrO_4$ | 10 | 1.3 |
| 7 | 3 | 10 | 60 | C | 15 | A | 0 | — | — | 1.0 |
| 8 | 0 | 0 | 80 | A | 15 | A | 0.5 | — | — | 1.2 |
| 9 | 0 | 10 | 70 | A | 15 | A | 0.5 | — | — | 1.3 |
| 10 | 0 | 0 | 50 | B | 0 | A | 0.5 | — | — | 1.2 |
| 11 | 0 | 0 | 60 | A | 15 | A | 0.5 | — | — | 1.3 |
| 12 | 0 | 10 | 50 | A | 20 | A | 0.5 | — | — | 0.8 |
| 13 | 0 | 10 | 60 | A | 15 | A | 0.5 | — | — | 1.3 |
| 14 | 0 | 0 | 70 | A | 15 | A | 0.5 | — | — | 1.4 |
| 15 | 0 | 10 | 100 | A | 15 | A | 0.5 | — | — | 0.9 |
| 16 | 2 | 0 | 60 | A | 15 | A | 0.5 | — | — | 1.3 |
| 17 | 0 | 0 | 70 | A | 15 | A | 0.5 | — | — | 1.1 |

TABLE 2-continued

| | | | | | | | | | | |
|---|---|---|---|---|---|---|---|---|---|---|
| 18 | 3 | 0 | 70 | A | 15 | A | 0.5 | — | — | 1.2 |
| 19 | 3 | 10 | 35 | A | 15 | A | 0.5 | $BaCrO_4$ | 10 | 1.3 |
| 20 | 0 | 0 | 35 | A | 15 | A | 0.5 | — | — | 1.2 |
| 21 | 3 | 0 | 60 | B | 30 | B | 0.5 | — | — | 1.0 |
| 22 | 3 | 10 | 60 | A | 15 | A | 0.5 | Butyral resin | 10 | 1.3 |
| 23 | 0 | 10 | 70 | B | 30 | B | 0 | $Fe_2P$ | 75 | 0.7 |
| 24 | 0 | 10 | 70 | A | 15 | A | 0.5 | — | — | 1.2 |
| 25 | 0 | 0 | 60 | A | 15 | A | 0.5 | — | — | 1.2 |
| 26 | 0 | 10 | 70 | A | 20 | A | 0.5 | — | — | 0.7 |
| 27 | 0 | 0 | 60 | A | 15 | A | 0.5 | — | — | 1.3 |
| 28 | 2 | 0 | 60 | A | 15 | A | 0.5 | — | — | 1.2 |
| 29 | 0 | 0 | 45 | A | 15 | A | 0.5 | — | — | 1.4 |
| 30 | 3 | 0 | 60 | B | 30 | B | 0.5 | — | — | 1.0 |
| 31 | 0 | 0 | 60 | A | 15 | A | 0.5 | — | — | 1.2 |
| 32 | 0 | 0 | 60 | A | 15 | A | 0.5 | — | — | 1.1 |
| 33 | 0 | 10 | 60 | A | 15 | A | 0.5 | — | — | 0.9 |
| 34 | 0 | 0 | 60 | A | 15 | A | 0.5 | — | — | 1.0 |
| 35 | 0 | 10 | 60 | A | 15 | A | 0.5 | — | — | 1.1 |
| A | 0 | 0 | 60 | A | 15 | A | 0.5 | — | — | 1.3 |
| B | 0 | 0 | 60 | A | 15 | A | 0.5 | — | — | 1.3 |
| C | 0 | 0 | 60 | A | 15 | A | 0.5 | — | — | 1.3 |
| D | 0 | 0 | 60 | A | 15 | A | 0.5 | — | — | 1.3 |
| E | 0 | 0 | 60 | A | 15 | A | 0.5 | — | — | 1.3 |
| F | 0 | 0 | 60 | A | 15 | A | 0.5 | — | — | 1.3 |
| G | 0 | 0 | 60 | A | 15 | A | 0.5 | — | — | 1.3 |
| H | 0 | 0 | 60 | A | 15 | A | 0.5 | — | — | 1.3 |
| I | 0 | 0 | 60 | A | 15 | A | 0.5 | — | — | 1.3 |
| J | 0 | 0 | 60 | A | 15 | A | 0.5 | — | — | 1.3 |
| K | 0 | 0 | 60 | A | 15 | A | 0.5 | — | — | 1.3 |
| L | 0 | 0 | 60 | A | 15 | A | 0.5 | — | — | 1.3 |
| M | 0 | 0 | 10* | A | 15 | A | 0.5 | — | — | 1.3 |
| N | 0 | 0 | 60 | A | 15 | A | 0.5 | — | — | 0.1* |
| O | 0 | 0 | 60 | A | 15 | A | 0.5 | — | — | 10* |
| P | 0 | 0 | 60 | A | 15 | A | 0.5 | — | — | 1.3 |
| Q | 0 | 0 | 60 | A | 15 | A | 0.5 | — | — | 1.3 |

Notes:
*Outside the range defined in the present invention.
1) Resin A: Polyhydroxypolyether resin (Mw = 35,000) derived from resorcinol and bisphenol—A.
Resin B: Polyhydroxypolyether resin (tradename: Phenoxy Resin PKHH) derived from bisphenol—A.
Resin C: Epoxy Resin (tradename: Epikote 1009).
2) Cross—linking agent A: Blocked isocyanate (releasing temperature = 80° C.).
Cross—linking agent B: Phenolic resin.

TABLE 3

| | Corrosion resistance | | | Wet | Dissolution of Cr | | Spot weldability | | |
|---|---|---|---|---|---|---|---|---|---|
| Run No. | % Red rust in flat area | % Red rust in cup area | Width of red rust from scribed lines (mm) | adhesion of paint coating | Degreasing solution ($mg/m^2$) | Phosphating solution ($mg/m^2$) | Stability | Tip diameter | Overall results |
| 1 | 0~1 | 2~3 | 1.6 | ○ | 0.2 | 0.1 | 0/100 | ○ | ○ |
| 2 | 0 | 0 | 0.1 | ○ | 0.1 | 0.1 | 2/100 | ○~Δ | ○~Δ |
| 3 | 0 | 0~1 | 0.3 | ○ | 0.7 | 0.5 | 0/100 | ○ | ○ |
| 4 | 0 | 0~1 | 0.3 | ○ | 0.1 | 0.1 | 0/100 | ○ | ○ |
| 5 | 0 | 5~6 | 0.2 | ○ | 0.5 | 0.4 | 0/100 | ○~Δ | ○~Δ |
| 6 | 0 | 0 | 0.5 | ○ | 0.9 | 0.7 | 0/100 | ○ | ○ |
| 7 | 0~1 | 3~4 | 1.7 | ○ | 0.4 | 0.6 | 0/100 | ○ | ○ |
| 8 | 0 | 0 | 0.1 | ○ | 0.3 | 0.3 | 0/100 | ○ | ○ |
| 9 | 0 | 0 | 0.1 | ○ | 0.2 | 0.1 | 0/100 | ○ | ○ |
| 10 | 0 | 0 | 0.3 | ○ | 0.3 | 0.2 | 0/100 | ○ | ○ |
| 11 | 0 | 0 | 0.2 | ○ | 0.2 | 0.2 | 0/100 | ○ | ○ |
| 12 | 0 | 0~1 | 0.4 | ○ | 0.2 | 0.1 | 0/100 | ○ | ○ |
| 13 | 0 | 0 | 0.2 | ○ | 0.2 | 0.1 | 0/100 | ○ | ○ |
| 14 | 0 | 0 | 0.1 | ○ | 0.1 | 0.1 | 0/100 | ○ | ○ |
| 15 | 0~2 | 6~7 | 1.5 | ○ | 0.2 | 0.1 | 0/100 | ○ | ○ |
| 16 | 0 | 0 | 0.2 | ○ | 0.1 | 0.1 | 0/100 | ○ | ○ |
| 17 | 0 | 0 | 0.1 | ○ | 0.1 | 0.1 | 0/100 | ○ | ○ |
| 18 | 0~1 | 3~4 | 0.2 | ○ | 0.1 | 0.2 | 0/100 | ○ | ○ |
| 19 | 1~2 | 4~5 | 1.2 | ○ | 0.6 | 0.3 | 0/100 | ○ | ○ |
| 20 | 0~2 | 2~3 | 1.3 | ○ | 0.1 | 0.1 | 0/100 | ○ | ○ |
| 21 | 0 | 0 | 0.8 | ○ | 0.2 | 0.1 | 0/100 | ○ | ○ |
| 22 | 0 | 0 | 1.0 | ○ | 0.6 | 0.3 | 0/100 | ○ | ○ |
| 23 | 0 | 0 | 0.1 | ○ | 0.7 | 0.5 | 2/100 | ○ | ○~Δ |
| 24 | 0 | 0 | 0.2 | ○ | 0.2 | 0.2 | 0/100 | ○ | ○ |
| 25 | 0 | 0 | 0.4 | ○ | 0.1 | 0.1 | 0/100 | ○ | ○ |
| 26 | 0 | 0 | 0.6 | ○ | 0.3 | 0.2 | 0/100 | ○ | ○ |
| 27 | 0 | 0 | 0.1 | ○ | 0.2 | 0.1 | 0/100 | ○ | ○ |
| 28 | 0 | 1~2 | 0.3 | ○ | 0.2 | 0.2 | 0/100 | ○ | ○ |
| 29 | 0 | 2~3 | 0.3 | ○ | 0.2 | 0.1 | 0/100 | ○ | ○ |
| 30 | 0 | 0 | 0.8 | ○ | 0.2 | 0.1 | 0/100 | ○ | ○ |
| 31 | 0 | 0 | 0.2 | ○ | 0.1 | 0.1 | 0/100 | ○ | ○ |

TABLE 3-continued

| Run No. | Corrosion resistance: % Red rust in flat area | % Red rust in cup area | Width of red rust from scribed lines (mm) | Wet adhesion of paint coating | Dissolution of Cr: Degreasing solution ($mg/m^2$) | Phosphating solution ($mg/m^2$) | Spot weldability: Stability | Tip diameter | Overall results |
|---|---|---|---|---|---|---|---|---|---|
| 32 | 0 | 0 | 0.1 | ○ | 0.2 | 0.1 | 0/100 | ○ | ○ |
| 33 | 0 | 0 | 0.1 | ○ | 0.2 | 0.2 | 0/100 | ○ | ○ |
| 34 | 0 | 0~1 | 0.1 | ○ | 0.2 | 0.1 | 0/100 | ○ | ○ |
| 35 | 0 | 0 | 0.2 | ○ | 0.1 | 0.1 | 0/100 | ○ | ○ |
| A | 1~2 | 50 | 4.5 | ○ | 0.3 | 0.2 | 4/100 | ○ | ○~Δ |
| B | 1~2 | 80 | 5.2 | ○ | 0.2 | 0.2 | 8/100 | ○~Δ | ○~Δ |
| C | 0~1 | 90 | 6.3 | ○ | 0.1 | 0.1 | 3/100 | ○~Δ | ○~Δ |
| D | 0~1 | 100 | >10 | ○ | 0.2 | 0.1 | 0/100 | ○ | ○ |
| E | 0~1 | 2 | >10 | ○ | 0.2 | 0.2 | 0/100 | ○ | ○ |
| F | 0~1 | 2 | >10 | ○ | 0.2 | 0.1 | 0/100 | ○ | ○ |
| G | 30 | 60 | 8.8 | X | 2.1 | 1.6 | 0/100 | ○ | ○ |
| H | 1~2 | 50 | 7.2 | ○ | 0.2 | 0.1 | 0/100 | ○ | ○ |
| I | 0~1 | 70 | 3.9 | Δ | 3.6 | 2.9 | 0/100 | ○ | ○ |
| J | 0~1 | 60 | 4.8 | Δ | 4.3 | 3.7 | 0/100 | ○ | ○ |
| K | 0~1 | 60 | 4.1 | Δ | 3.9 | 2.3 | 0/100 | ○ | ○ |
| L | 0~1 | 50 | 9.5 | ○ | 0.2 | 0.1 | 0/100 | ○~Δ | ○~Δ |
| M | 90 | 100 | >10 | ○ | 0.3 | 0.1 | 0/100 | ○ | ○ |
| N | 80 | 100 | >10 | ○ | 14.3 | 12.9 | 0/100 | ○ | ○ |
| O | 0 | 0~1 | 0.1 | X | 0.1 | 0 | Failure | — | X |
| P | 1~2 | 90 | 0.2 | ○ | 0.3 | 0.2 | 0/100 | ○ | ○ |
| Q | 1~2 | 100 | 0.1 | ○ | 0.2 | 0.1 | 0/100 | ○ | ○ |

TABLE 4

| Run No. | First Ni—Zn plating: % Ni | Weight ($g/m^2$) | Second Ni—Zn plating: % Ni | Weight ($g/m^2$) | Thickness of Lubricating coating layer (mm) | Chromate film Weight as Cr ($mg/m^2$) | Organic layer Thickness (μm) | Cosmetic Corrosion Resistance (mm) | Perforative Corrosion Resistance (mm) | Sliding properties (Coeff. of friction) | Electro-deposition coatability |
|---|---|---|---|---|---|---|---|---|---|---|---|
| 1 | 6 | 10 | — | — | 1.0 | — | — | 3.1 | — | 0.16 | ◎ |
| 2 | 6 | 20 | — | — | 1.0 | — | — | 1.8 | — | 0.14 | ◎ |
| 3 | 6 | 30 | — | — | 1.0 | — | — | 1.5 | — | 0.15 | ◎ |
| 4 | 6 | 50 | — | — | 1.0 | — | — | 0.3 | — | 0.15 | ◎ |
| 5 | 0 | 20 | — | — | 1.0 | — | — | 0.2 | — | 0.16 | ◎ |
| 6 | 6 | 20 | — | — | 1.0 | — | — | 2.4 | — | 0.17 | ◎ |
| 7 | 2Ni—0.1Co | 20 | — | — | 1.0 | — | — | 2.6 | — | 0.19 | ◎ |
| 8 | 4 | 20 | — | — | 1.0 | — | — | 1.5 | — | 0.14 | ◎ |
| 9 | 8 | 20 | — | — | 1.0 | — | — | 1.9 | — | 0.14 | ◎ |
| 10 | 10 | 20 | — | — | 1.0 | — | — | 2.3 | — | 0.13 | ◎ |
| 11 | 6 | 20 | — | — | 0.5 | — | — | 1.8 | — | 0.16 | ◎ |
| 12 | 6 | 20 | — | — | 0.7 | — | — | 1.8 | — | 0.16 | ◎ |
| 13 | 6 | 20 | — | — | 1.5 | — | — | 1.8 | — | 0.15 | ◎ |
| 14 | 6 | 20 | — | — | 2.0 | — | — | 1.8 | — | 0.15 | ◎ |
| 15 | 6 | 20 | — | — | 2.7 | — | — | 1.8 | — | 0.13 | ◎ |
| 16 | 6 | 20 | 13 | 0.5 | — | 100 | 1.0 | 1.8 | 0.12 | 0.12 | ○ |
| 17 | 6 | 20 | 13 | 2 | — | 100 | 1.0 | 1.8 | 0.05 | 0.12 | ○ |
| 18 | 6 | 20 | 13 | 5 | — | 100 | 1.0 | 1.9 | 0 | 0.12 | ○ |
| 19 | 6 | 20 | 13 | 10 | — | 100 | 1.0 | 2.0 | 0 | 0.11 | ○ |
| 20 | 6Ni—0.2Co | 20 | 10 | 5 | — | 100 | 1.0 | 2.0 | 0.05 | 0.12 | ○ |
| 21 | 6 | 20 | 20 | 5 | — | 100 | 1.0 | 2.2 | 0 | 0.11 | ○ |
| 22 | 6 | 20 | 30 | 5 | — | 100 | 1.0 | 2.6 | 0 | 0.10 | ○ |
| 23 | 6 | 20 | 40 | 5 | — | 100 | 1.0 | 3.4 | 0.06 | 0.10 | ○ |
| 24 | 6 | 20 | 13 | 5 | — | 30 | 1.0 | 2.4 | 0.10 | 0.11 | ○ |
| 25 | 6 | 20 | 13 | 5 | — | 50 | 1.0 | 2.2 | 0.05 | 0.12 | ○ |
| 26 | 6 | 20 | 13 | 5 | — | 160 | 1.0 | 1.5 | 0 | 0.12 | ○ |
| 27 | 6 | 20 | 13 | 5 | — | 300 | 1.0 | 1.0 | 0 | 0.12 | Δ |
| 28 | 6 | 20 | 13 | 5 | — | 100 | 0.3 | 2.2 | 0.15 | 0.18 | ◎ |
| 29 | 6 | 20 | 13 | 5 | — | 100 | 0.6 | 2.0 | 0 | 0.16 | ○ |
| 30 | 6 | 20 | 13 | 5 | — | 100 | 2.0 | 1.4 | 0 | 0.12 | ○ |
| 31 | 0 | 20 | 13 | 5 | — | 100 | 1.0 | 1.0 | 0.05 | 0.12 | ○ |
| A | 6 | 5* | — | — | 1.0 | — | — | 5.8 | — | 0.15 | ◎ |
| B | 13* | 20 | — | — | 1.0 | — | — | 6.5 | — | 0.11 | ◎ |
| C | 16* | 20 | — | — | 1.0 | — | — | 7.3 | — | 0.10 | ◎ |
| D | 6 | 20 | — | — | 0.1* | — | — | 1.8 | — | 0.31 | ◎ |
| E | 6 | 20 | — | — | 0.3* | — | — | 1.8 | — | 0.32 | ◎ |
| F | 6 | 20 | 6* | 5 | — | 100 | 1.0 | 1.6 | 0.31 | 0.12 | ○ |
| G | 6 | 20 | 50* | 5 | — | 100 | 1.0 | 2.2 | 0.25 | 0.10 | ○ |
| H | 6 | 20 | 13 | 5 | — | 15* | 1.0 | 1.9 | 0.64 | 0.11 | ○ |
| I | 6 | 20 | 13 | 5 | — | 360* | 1.0 | 1.8 | 0 | 0.11 | X |
| J | 6 | 20 | 13 | 5 | — | 100 | 0.1* | 1.7 | Perforated | 0.25 | ◎ |

*Outside the range defined in the present invention.

TABLE 5

| Run No. | Ni—Zn plating % Ni | Ni—Zn plating Weight ($g/m^2$) | Weight of Zinc phosphate coating layer ($g/m^2$) | Cosmetic Corrosion Resistance (mm) | Sliding properties (Coeff. of friction) | Electro—deposition coatability |
|---|---|---|---|---|---|---|
| 1 | 5 | 10 | 2.5 | 3.0 | 0.15 | ◎ |
| 2 | 5 | 20 | 2.5 | 1.8 | 0.16 | ◎ |
| 3 | 5 | 30 | 2.5 | 1.2 | 0.18 | ◎ |
| 4 | 5 | 40 | 2.5 | 0.5 | 0.17 | ◎ |
| 5 | 5 | 50 | 2.5 | 0.4 | 0.17 | ◎ |
| 6 | 8 | 20 | 2.1 | 2.5 | 0.13 | ◎ |
| 7 | 10 | 20 | 2.0 | 2.8 | 0.10 | ◎ |
| 8 | 5 | 20 | 0.1 | 2.3 | 0.20 | ◎ |
| 9 | 5 | 20 | 0.2 | 2.3 | 0.18 | ◎ |
| 10 | 5 | 20 | 3.9 | 1.5 | 0.15 | ◎ |
| 11 | 5 | 20 | 4.5 | 1.0 | 0.15 | ◎ |
| A | 5 | 5* | 2.5 | 5.8 | 0.15 | ◎ |
| B | 13* | 20 | 2.4 | 7.9 | 0.12 | ◎ |
| C | 16* | 20 | 2.2 | 8.5 | 0.12 | ◎ |
| D | 5 | 20 | 0.05* | 1.2 | 0.32 | ◎ |
| E | 5 | 20 | 0.08* | 1.2 | 0.25 | ◎ |

*Outside the range defined in the present invention.

What is claimed is:

1. A surface-coated steel sheet having improved corrosion resistance, comprising a steel sheet having on at least one surface thereof an inorganic-organic composite coating which comprises the following layers (a) to (d) from bottom to top of the coating:

(a) a first zinc alloy plating layer with a coating weight of 10–100 $g/m^2$ which contains at least one of nickel (Ni) and cobalt (Co) as an alloying element in an amount satisfying the following inequality:

$$0.05 \leqq (5 \times Co) + Ni \leqq 10 \quad \text{in weight percent,}$$

(b) a second zinc alloy plating layer with a coating weight of 0.05–10 $g/m^2$ which contains at least one of Ni and Co as an alloying element in an amount satisfying the following inequality:

$$10 < (5 \times Co) + Ni \leqq 40 \quad \text{in weight percent,}$$

(c) a chromate film layer with a coating weight of 20–300 $mg/m^2$ as Cr, and (d) an organic coating layer, with a thickness of 0.2–5 μm.

2. The surface-coated steel sheet of claim 1 wherein the first zinc alloy plating layer includes microcracks.

3. The surface-coated steel sheet of claim 2 wherein the microcracks have a width of from 0.01 to 0.5 μm and said microcracks occupy from 10% to 60% of an area of the first layer.

4. The surface-coated steel sheet of claim 1 wherein at least one of the first and second zinc alloy plating layers contains at least one metal oxide selected from the group consisting of $Al_2O_3$, $SiO_2$, $TiO_2$, $ZrO_2$, $PbO_2$, $Pb_2O_3$, $SnO_2$, SnO, $Sb_2O_5$, $Sb_2O_3$, $Fe_2O_3$, and $Fe_3O_4$ in an amount of not more than 10% by weight as the metal content.

5. The surface-coated steel sheet of claim 1 wherein at least one of the first and second zinc alloy plating layers the group consisting of Al, Si, Nb, Mn, Mg, Mo, Ta, Cu, Sn, Sb, Ti, Cr, Cd, Pb, Tl, In, V, W, P, S, B, and N, the content of said additional alloying element being smaller than the content of said at least one of Ni and Co.

6. The surface-coated steel sheet of claim 1 wherein the chromate film layer is formed from a chromating solution of a coating type which has been partially reduced such that a ratio of $Cr^{3+}$ ion content to total Cr ion content of the solution is in a range of from 0.2 to 0.6.

7. The surface-coated steel sheet of claim 6 wherein the chromating solution contains at least one additive selected from the group consisting of silica in an amount of 0.1 to 4 times a total weight of chromic acids, iron phosphide in an amount of 0.1 to 20 times the total weight of chromic acids, and a difficultly-soluble chromate pigment in an amount of 0.1 to 1 times a total weight of Cr ions.

8. The surface-coated steel sheet of claim 6 wherein the partially reduced chromating solution contains a silane coupling agent in an amount of at least 0.01 moles for each mole of unreduced chromic acid remaining in the solution.

9. The surface-coated steel sheet of claim 7 wherein the partially reduced chromating solution contains a silane coupling agent in an amount of at least 0.01 mole for each mole of unreduced chromic acid remaining in the solution.

10. The surface-coated steel sheet of claim 6 wherein a reducing agent selected from the group consisting of polyhydric alcohols, polycarboxylic acids, and hydroxycarboxylic acids is added to the partially reduced chromating solution in an amount of from 0.02 to 4 equivalents for each mole of unreduced chromic acid remaining in the solution.

11. The surface-coated steel sheet of claim 1 wherein the organic coating layer is formed from a coating Composition based on a resin selected from the group consisting of epoxy resins, modified epoxy resins, polyhydroxypolyether resins, acrylic resins, and modified acrylic resins.

12. The surface-coated steel sheet of claim 11 wherein the coating composition further comprises a cross-linking agent in such an amount that a number of cross-linkable functional groups in the agent is from 0.1 to 2.0 times a total number of epoxy, hydroxyl, and carboxyl groups in the resin, and/or an inorganic filler in an amount of from 1 to 40 wt % based on weight of the resin.

13. The surface-coated steel sheet of claim 11 wherein the coating composition is based on an acrylic resin or a modified acrylic resin containing at least one oxidatively cross-linkable carbon-carbon double bond in the molecule.

14. The surface-coated steel sheet of claim 13 wherein the coating composition further comprises an inorganic filler in amount of from 1 to 40 wt % based on the weight of the resin.

15. The surface-coated steel sheet of claim 1 wherein the steel sheet is bake-hardenable and the chromate film layer and the organic coating layer are both formed by baking at temperatures below 200° C.

16. The surface-coated steel sheet of claim 1 wherein the steel sheet has the inorganic-organic composite coating on both surfaces thereof.

17. The surface-coated steel sheet of claim 1 wherein the steel sheet has the inorganic-organic composite coating on one surface and the other surface of the steel sheet is coated with a duplex plating comprising a lower layer of zinc or a zinc alloy containing at least one of Ni and Co in an amount as defined in (a) of claim 1 and an upper layer of a zinc alloy containing at least one of Ni and Co in an amount as defined in (b) of claim 1.

18. The surface-coated steel sheet of claim 1 wherein the steel sheet has the inorganic-organic composite coating on one surface and the other surface of the steel sheet is coated with a lower plating-layer of zinc or a zinc alloy containing at least one of Ni and Co in an amount as defined in (a) of claim 1 and an upper removable solid lubricating coating layer.

19. The surface-coated steel sheet of claim 1 wherein the steel sheet has the inorganic-organic composite coating on one surface and the other surface of the steel sheet is coated with a lower plating layer of zinc or a zinc alloy containing at least one of Ni and Co in an amount as defined in (a) of claim 1 and an upper zinc phosphate coating layer.

20. The surface-coated steel sheet of claim 1, wherein a total amount of Ni+Co of the second plating layer exceeds a total amount of Ni+Co of the first plating layer and the first plating layer is thicker than the second plating layer.

21. The surface-coated sheet of claim 1, wherein the first plating layer contains a lower amount of alloying elements than the second plating layer.

22. The surface-coated sheet of claim 1, wherein the first plating layer is a base plating layer which exhibits sacrificial protection against corrosion to improve cosmetic corrosion resistance and the second plating layer exhibits improved adhesion to the chromate layer to improve perforative corrosion resistance.

* * * * *